US012474132B2

(12) United States Patent
Kosman

(10) Patent No.: US 12,474,132 B2
(45) Date of Patent: Nov. 18, 2025

(54) ENHANCED BOLT CARRIER ASSEMBLY

(71) Applicant: Kurt Andrew Kosman, Albany, MO (US)

(72) Inventor: Kurt Andrew Kosman, Albany, MO (US)

( * ) Notice: Subject to any disclaimer, the term of this patent is extended or adjusted under 35 U.S.C. 154(b) by 0 days.

Patent file contains an affidavit/declaration under 37 CFR 1.130(b).

(21) Appl. No.: 18/747,810

(22) Filed: Jun. 19, 2024

(65) Prior Publication Data

US 2025/0297818 A1 Sep. 25, 2025

Related U.S. Application Data

(60) Provisional application No. 63/567,570, filed on Mar. 20, 2024.

(51) Int. Cl.
*F41A 5/24* (2006.01)
*F41A 3/26* (2006.01)

(52) U.S. Cl.
CPC . *F41A 5/24* (2013.01); *F41A 3/26* (2013.01)

(58) Field of Classification Search
CPC ..... F41A 5/24
See application file for complete search history.

(56) References Cited

U.S. PATENT DOCUMENTS

| | | | | |
|---|---|---|---|---|
| 2,951,424 | A * | 9/1960 | Stoner | F41A 3/26 89/185 |
| 7,275,472 | B1 * | 10/2007 | Finn | F41A 5/24 89/26 |
| 10,041,750 | B2 * | 8/2018 | Oglesby | F41A 13/00 |
| 10,151,544 | B1 * | 12/2018 | Sugg | F41A 5/26 |
| 10,168,115 | B1 * | 1/2019 | Oglesby | F41A 3/68 |
| 11,204,208 | B1 * | 12/2021 | Aitken | F41A 3/26 |
| 2006/0236582 | A1 * | 10/2006 | Lewis | F41C 27/00 42/73 |
| 2007/0199435 | A1 * | 8/2007 | Hochstrate | F41A 5/26 42/72 |
| 2014/0144314 | A1 * | 5/2014 | Jensen | F41A 5/24 89/193 |
| 2016/0123685 | A1 * | 5/2016 | Oglesby | F41A 13/00 89/180 |
| 2025/0067530 | A1 * | 2/2025 | Reis-Green | F41A 5/26 |

* cited by examiner

*Primary Examiner* — Gabriel J. Klein
(74) *Attorney, Agent, or Firm* — Ilya Chernyavskiy; Bennet K. Langlotz; Langlotz Patent & Trademark Works, LLC

(57) ABSTRACT

A bolt carrier assembly having a bolt carrier with at least one gas exit hole located at the bottom of the bolt carrier so as to allow the passage of gas generated from a discharged round of ammunition downward into the magazine and magazine well of a firearm, away from the user.

2 Claims, 13 Drawing Sheets

ENHANCED BOLT CARRIER ASSEMBLY

CROSS-REFERENCE TO RELATED APPLICATIONS

This application claims priority to U.S. Provisional Patent Application No. 63/567,570 filed on Mar. 20, 2024 entitled "K-SPEC ENHANCED BOLT CARRIER" hereby incorporated by reference in its entirety for all that is taught and disclosed therein.

FIELD OF THE TECHNOLOGY

The present disclosure relates to firearms, specifically a bolt carrier assembly for semi-automatic firearms.

BACKGROUND

Semi-automatic firearms such as variants of the AR-15 and AR-10 style of rifles and pistols function to cycle casings from discharged ammunition by utilizing return gas to operate the bolt carrier group. The basic operation of such firearms follows the disclosure U.S. Pat. No. 2,951,424 by Eugene M. Stoner. For general purposes the discussion and disclosure will utilize a rifle variant though non-rifle variants such as pistols may function similarly. The bolt carrier has two holes on its side, facing the ejection port when the carrier is fully forward in the receiver of a rifle. This is a key feature of typical bolt carriers. The bolt carrier moves away from the barrel breach due to gas generated by a discharged round of ammunition returning from the barrel via a gas tube and acting upon a carrier key attached to the bolt carrier and interfacing with the gas tube. Before the carrier key pulls completely away from the gas tube, gas rings on the bolt residing within the bolt carrier pass the front of these two holes, allowing gas to escape to the outside of the receiver. This gas carries debris towards the face of a user of such a firearm and can cause irritation or obstruction of field of view.

SUMMARY

Therefore, a need exists for a bolt carrier comprising of a body defining a bore; a bolt in the bore; the bolt carrier defining a first gas passage communicating with the bore; the gas passage extending in a downward direction; and the gas passage having an exit aperture at a lower portion of the bolt carrier

BRIEF DESCRIPTION OF DRAWINGS

The subject matter regarded as the present embodiment is particularly pointed out and distinctly claimed in the concluding portion of the specification. The embodiment, however, both as to organization and method of operation, together with objects, features, and advantages thereof, may best be understood by reference to the following detailed description when read with the accompanying drawings in which:

DETAILED DESCRIPTION OF THE CURRENT EMBODIMENT

Figure 1:
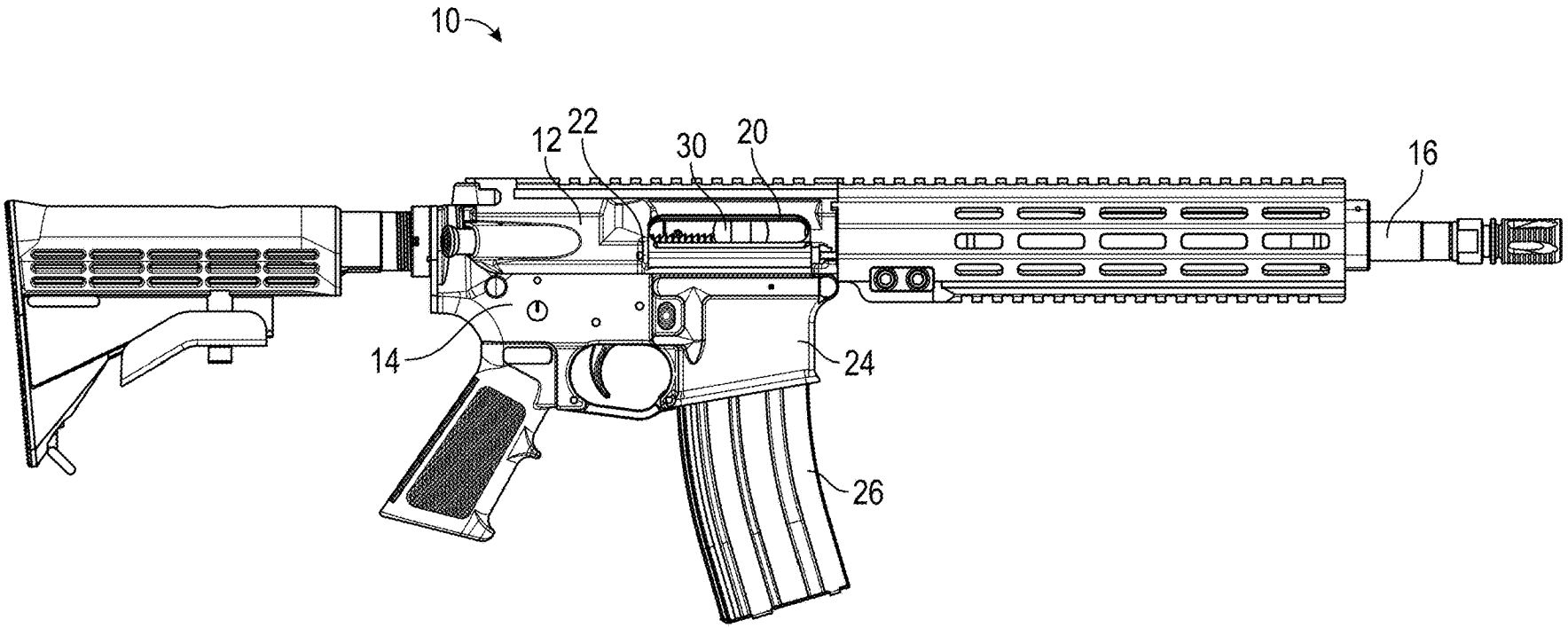
FIG. 1 shows an AR-15 style rifle with a magazine inserted, dust cover down, and the bolt carrier assembly fully forward showing an absence of side gas holes.

In the following detailed description, numerous specific details are set forth in order to provide a thorough understanding of embodiments. However, it will be understood by those of ordinary skill in the art that the embodiments may be practiced without these specific details. In other instances, well-known methods, procedures, and components have not been described in detail so as not to obscure the embodiments and disclosures. Non-limiting and non-exhaustive embodiments will be described with reference to the following figures, wherein like reference numerals refer to like parts throughout the various figures unless otherwise specified.

An embodiment of the bolt carrier assembly is shown and generally designated by reference numeral 30.

FIG. 1 shows a side view of a rifle 10 having an upper receiver 12 and lower receiver 14. The upper receiver having an attached barrel 16 received partially within the upper receiver, and an ejection port 20 with a corresponding moveable ejection port cover 22. In some embodiments the ejection port cover is absent. The lower receiver has a magazine well 24 and a detachable magazine 26 inserted into the magazine well. A bolt carrier assembly 30 is seen with a noticeable absence of side visible gas holes from its right, ejection port, side.

Figure 2A:
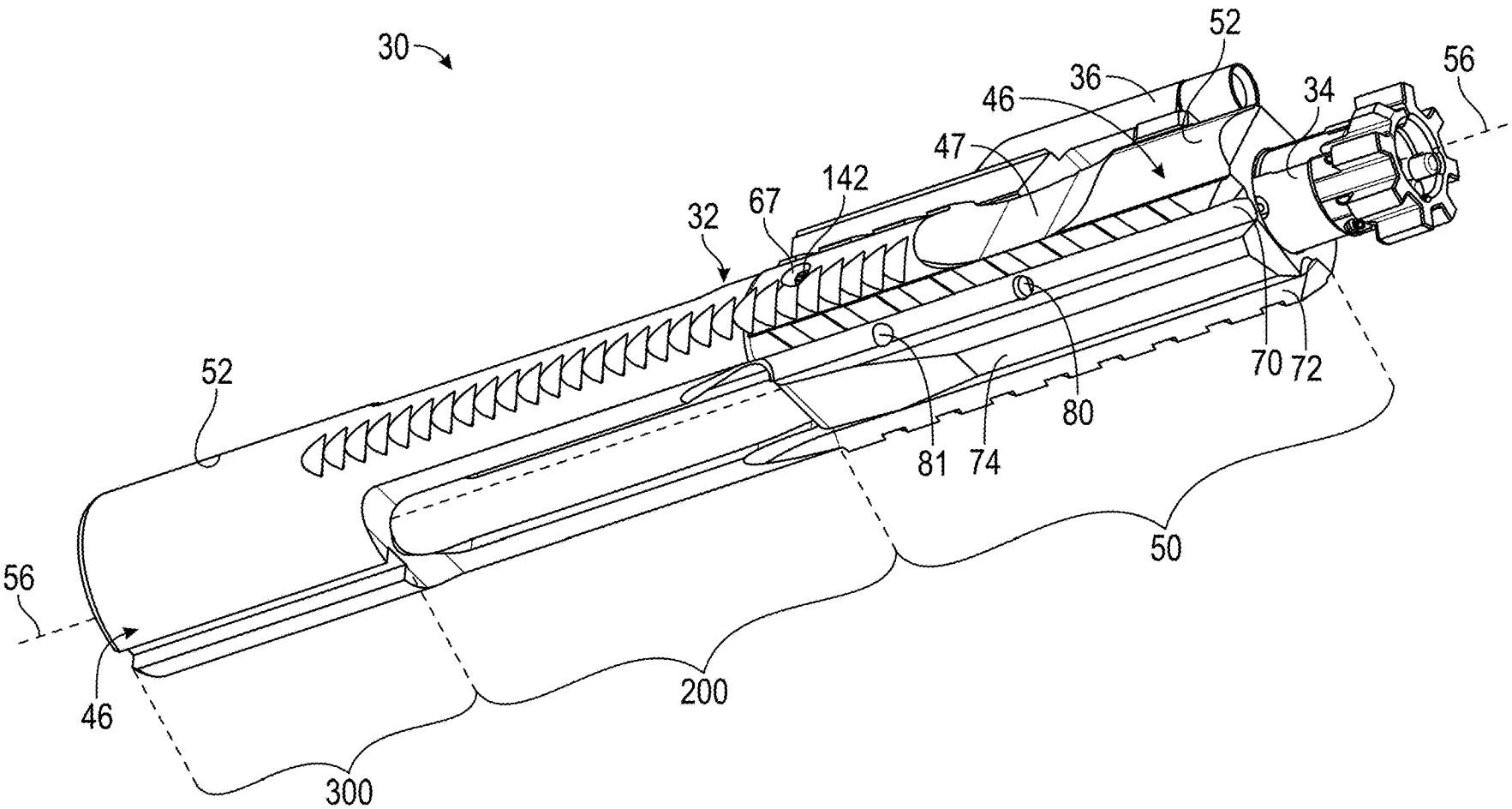
FIG. 2A shows an angled bottom-up view of the bolt carrier assembly with the bolt facing to the right.
Figure 2B:
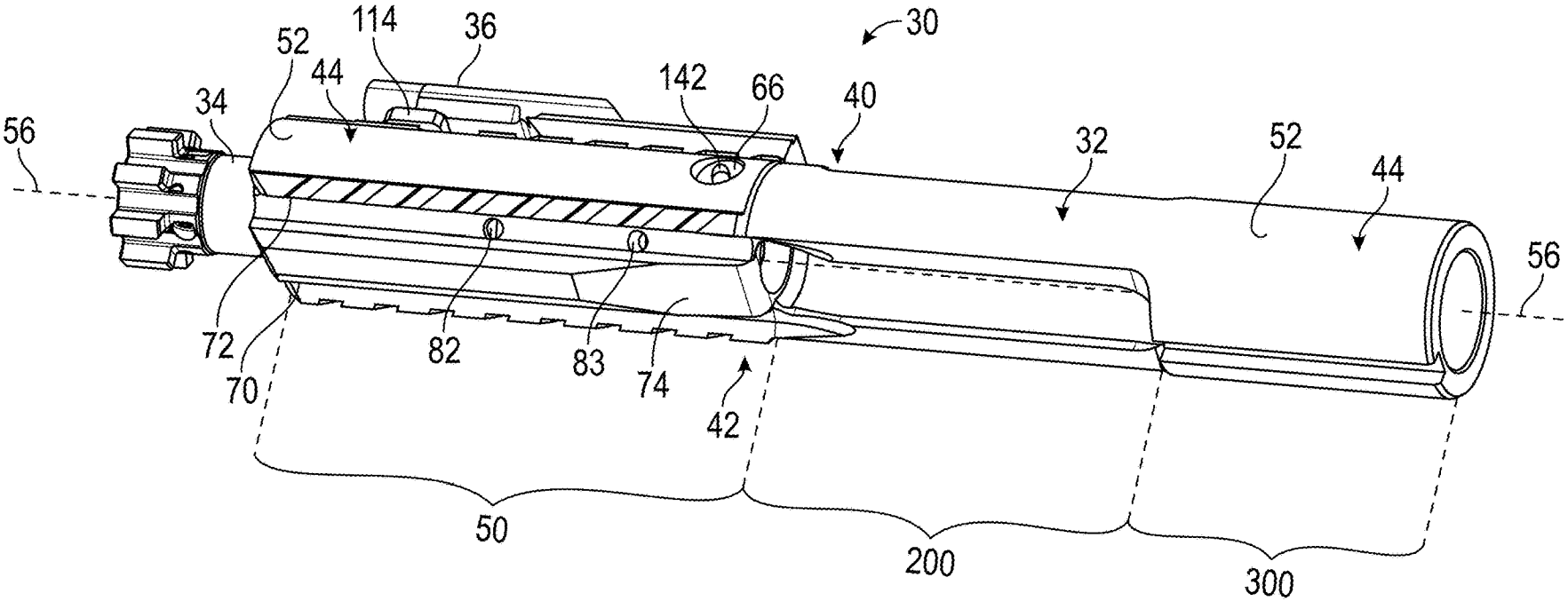
FIG. 2B shows an opposing angled bottom-up view of the bolt carrier assembly with the bolt facing to the left.

FIGS. 2A and 2B show the bolt carrier assembly 30 comprised of a bolt carrier 32, a bolt 34, and a carrier key 36. The bolt carrier being an elongated body defining a bore (54 in FIG. 4) having a top side 40 and a bottom side 42. FIG. 2A shows the bolt having a right side 46 oriented in the same direction as the ejection port 20 when the bolt is installed into a rifle 10, as shown in FIG. 1. The right side 46 has a recessed area 47. FIG. 2B shows the bolt having a left side 44, the length corresponding to the entire length of the inside of the upper receiver 14 in the present embodiment. The bolt carrier further having a bolt section 50, hammer section 200, and end section 300 sharing a continuous surface 52 and bore 54 (FIG. 4) along bore axis 56. The left side of the bolt section defining a first retaining pin hole 66 and the right side defining a corresponding second retaining pin hole 67, both through holes in line with one another, the firing pin retaining pin 142 passing transversely through the first hole 66 towards and through the second hole 67 to retain the firing pin 140 (not visible here). Along the entire length of the bottom of bolt section 50 is a right groove 70, a left groove 72, and a boss 74 in between the two grooves. In the present embodiment shown there are four gas bottom gas holes, being through holes, also referred to as exit apertures: a first 80 and second 81 in line with one other within the right groove, and a third 82 and fourth 83 in line with one another in the left grove. The holes are angled in this embodiment and traverse entirely through the carrier. The first 80 and third 82 holes are located within the central area of the bolt section 50, and the second 81 and fourth 83 holes are located along the bolt section closer towards the hammer section 200. In this embodiment the right side 46 recessed area 47 of the bolt body section does not have the two lateral vent holes (86 in FIG. 3C and FIG. 3D) found on a typical bolt carrier (FIG. 3C 32')

Figure 3A:
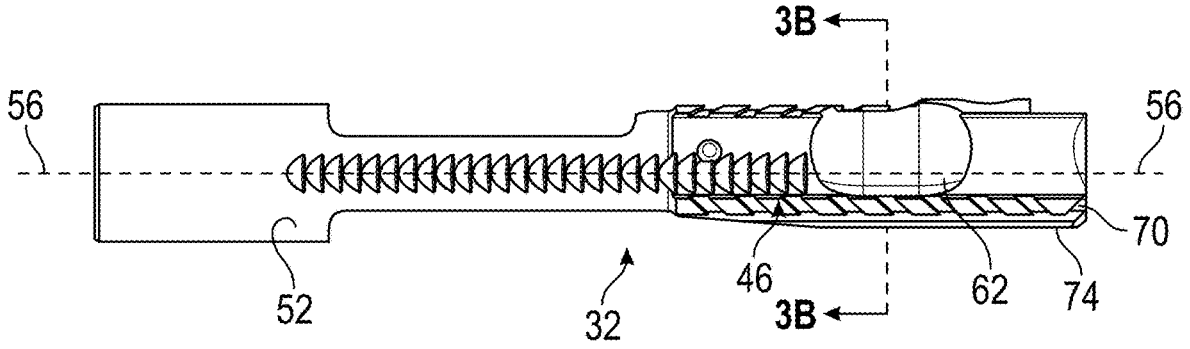
FIG. 3A shows a bolt carrier with gas holes oriented downward and an absence of side gas holes.
Figure 3B:
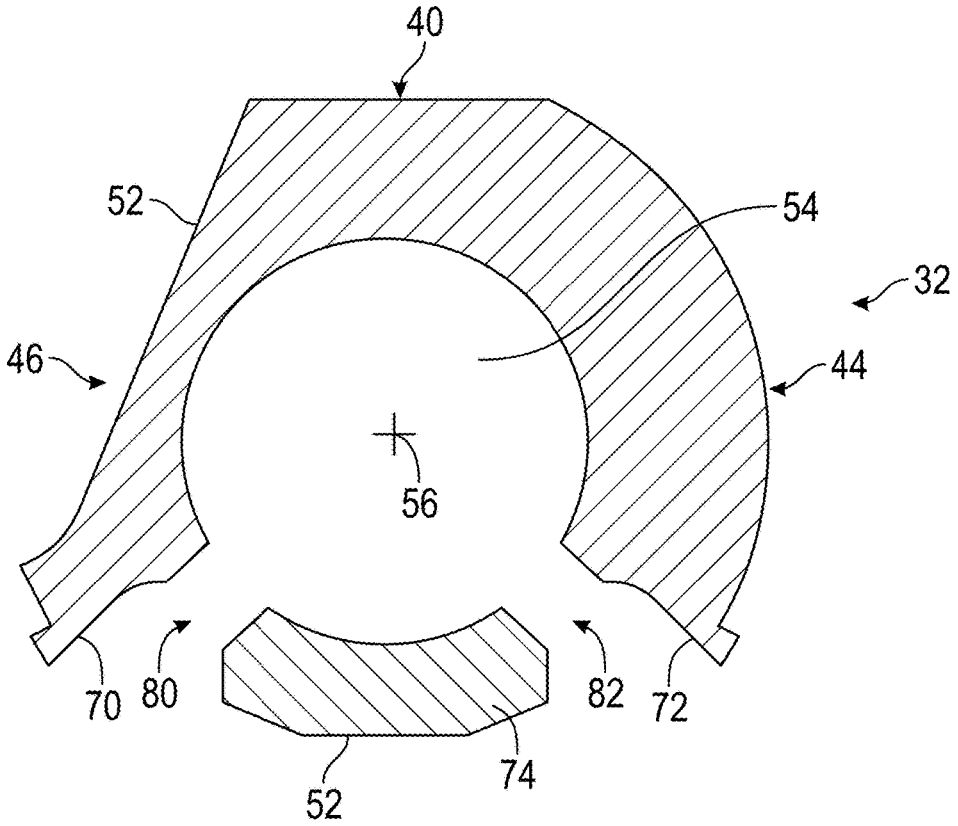
FIG. 3B shows a section view of the bolt carrier of FIG. 3A where the downward gas holes are visible.
Figure 3C:
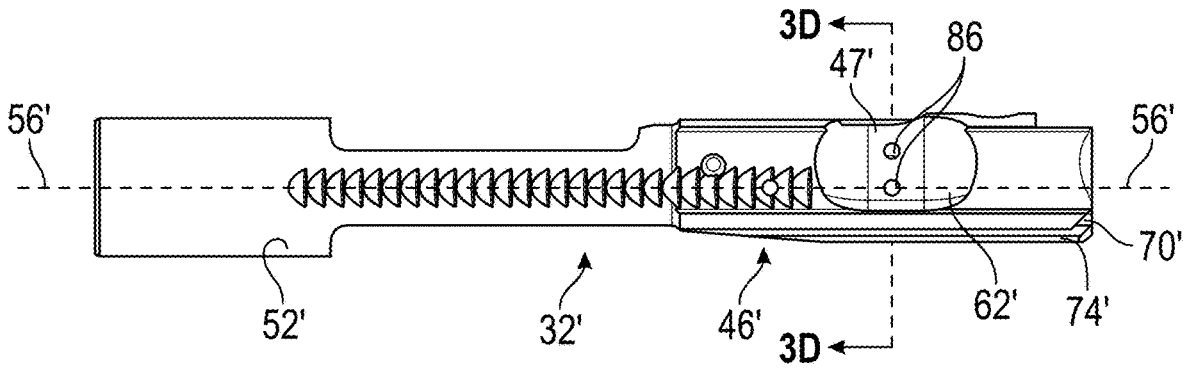
FIG. 3C shows a typical bolt carrier with the gas holes oriented towards the side.
Figure 3D:
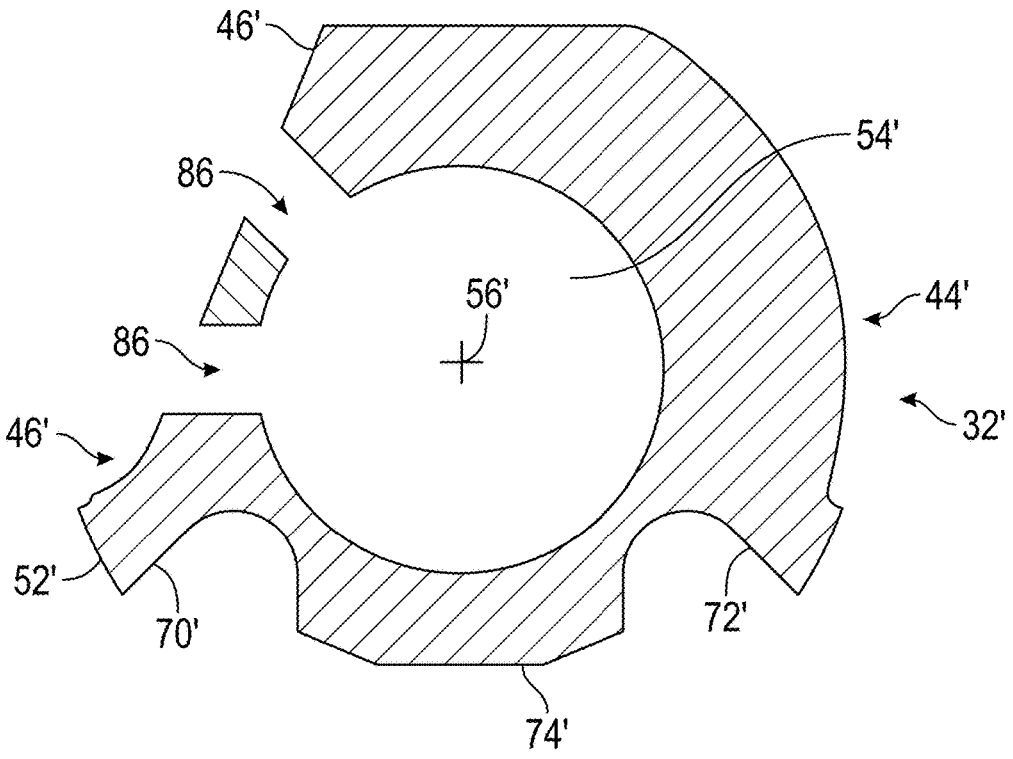
FIG. 3D shows a section view of the bolt carrier of FIG. 3C where the side vent holes are visible and there is an absence of bottom gas holes.

FIG. 3A shows a right-side view of the bolt carrier 32 without carrier key 36, with designated cross section shown in FIG. 3B going through the first 80 bottom gas hole and third bottom gas hole 82 of the bolt section 50 of grooves 70 and 72. The holes traverse completely through bottom of the bolt carrier, going from the outer surface 52 to the bore 54. The holes transverse completely through the surface 52 of the bottom side 42 of the bolt carrier. FIG. 3C shows a right-side view of a conventional bolt carrier 32', with two lateral gas holes 86 defined by a recessed area 47', as they would be conventionally. There are otherwise corresponding parts to the disclosed bolt carrier 32, recessed section 47', right groove 70', left groove 72', and boss 74'. FIG. 3D is a section view designated in FIG. 3C, and shows that there are no bottom holes in right groove 70' and left groove 72', but there is a pair of gas holes 86 defined by the recessed area 47' of right side 46', that transverse from the surface 52' to the bore 54' around central bore axis 56'. In the present embodiment, the bottom gas holes 80 and 82 seen in FIGS. 2A and 2B are along the corresponding planar axis as the lateral gas holes 86 shown along section cut A-A in FIG. 3C, but located on the bottom of the carrier and spaced farther apart relative to the spacing between holes 86.

Figure 4:
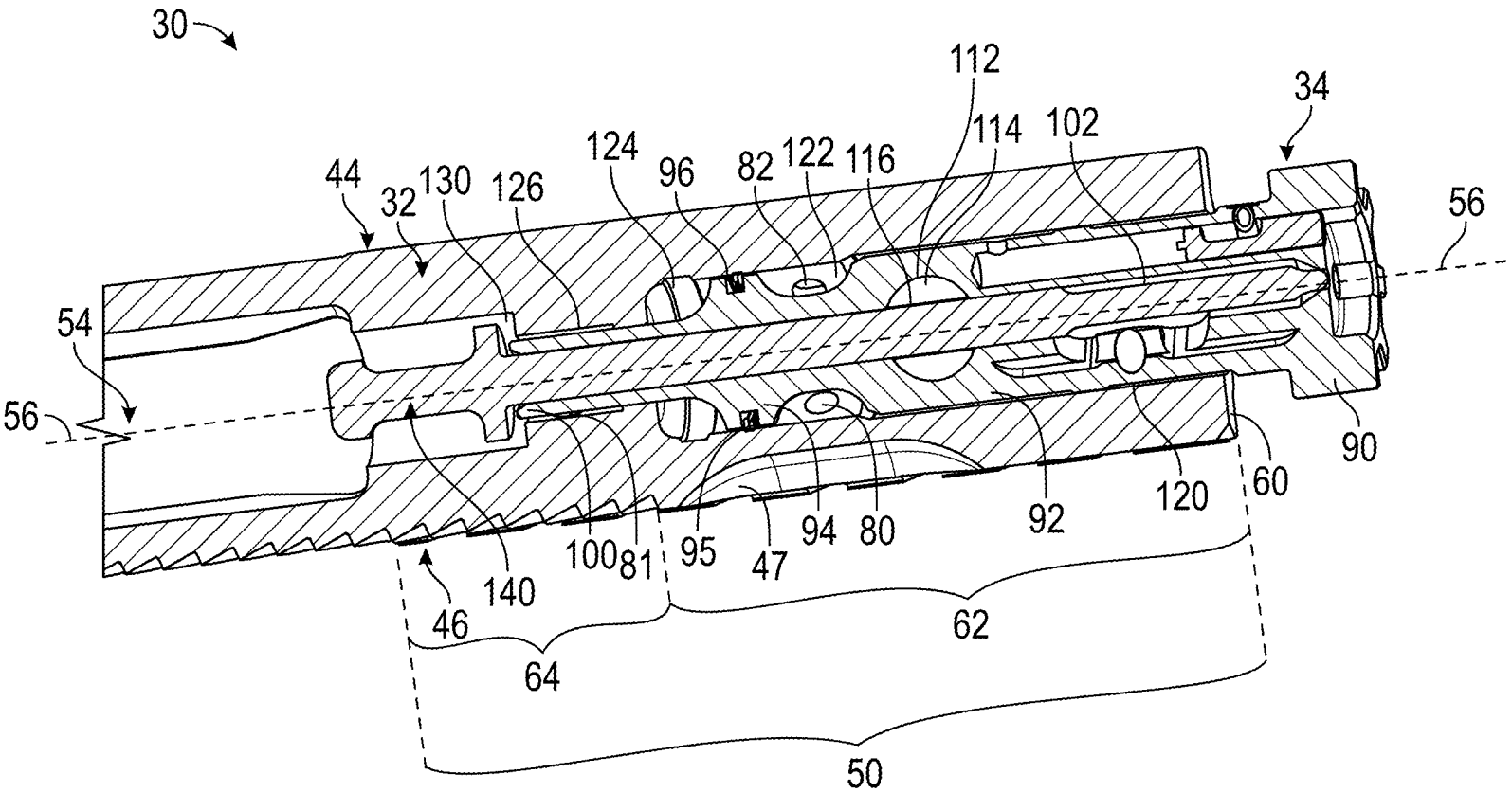
FIG. 4 shows a top-down section view of the bolt carrier assembly.

FIG. 4 shows a section view of the bolt carrier assembly 30 from the top looking down. Most of the bolt 34 resides within the bolt carrier 32 bolt section 50. The bolt having a head 90, body 92, gas rings section 94 with gas rings channel 96, and bolt tail 100. The bolt further defines an internal firing pin channel 102 that surrounds most of the firing pin 140 when the pin is inserted into the bolt. In the current embodiment three gas rings 95 are within the gas ring channel and function to intercept gases in order to utilize the pressure to cause the bolt to move during cycling. When installed within the bolt carrier, the bolt is within the bolt section 50 of the carrier 32, having a bolt body portion 62 and bolt tail end 64. The bolt body portion containing most of the bolt and having a bolt body channel 120 that is on the opposite end of the bolt carrier assembly from the carrier end 300 and is open-ended at the bolt carrier face 60. The bolt section further has the following sections going in an order from the bolt carrier face towards the bolt carrier end: a carrier gas ring channel 122 having a narrower diameter than bolt body channel, and a gas space 124. The bolt tail end 64 has a bolt tail channel 126 having a narrower diameter than the carrier gas rings channel, and carrier firing pin channel 130. The bolt head 90 is outside of the bolt carrier bolt head end 60, the bolt body 92 is within the bolt body channel 120, the gas rings section 94 and gas rings 95 are within the carrier gas rings channel 122, most of the bolt tail is within most of the bolt tail channel 126. The bolt body defines a bolt cam pin hole 112 that retains a cam pin 114. The cam pin defines a hole 116 that allows the firing pin 140 to move freely through it.

The bolt 34 is moveable within the bolt carrier 32, being able to be in a seated condition where the bolt is as far within the bolt carrier as possible, and an extended position where the bolt head is away from the bolt carrier, but the bolt is still retained and held partially within the bolt carrier by the cam pin 114.

FIG. 4 further shows the bottom gas holes 80 and 82 located at the carrier gas ring channel 122. In the present embodiment, the holes are located such that when the bolt is in its seated position, as presently shown, the bolt's gas rings section 94 is rearward of the gas holes 80 and 82. In the extended position the bolt has moved forward, and the gas rings section partially obstructs the holes.

The sequence of operation of the bolt carrier assembly happens very quickly as a result of a discharged round of ammunition. Gas from a discharged round comes through the gas carrier key and enters gas space 126 while the bolt 34 is still in a seated position where the bolt is as far inside the bolt carrier as it can be, as shown in FIG. 4. The gas rings 95 keep the gas temporarily contained and the resulting pressure causes the bolt carrier 32 to move backwards. The bolt head 90 temporarily remains within the chamber of the barrel, maintaining its position while the bolt carrier moves backwards, resulting in the bolt sliding forward relative to the carrier moving backward, to be in an extended condition. In the extended condition, the gas rings are forward of the gas holes 80 and 82, allowing the gas to escape. In a conventional bolt carrier 32' having the gas holes 86 laterally oriented, the gas would escape towards the user. In the present embodiment, the gas instead travels downward through holes 80 and 82, away from the user.

Figure 5:
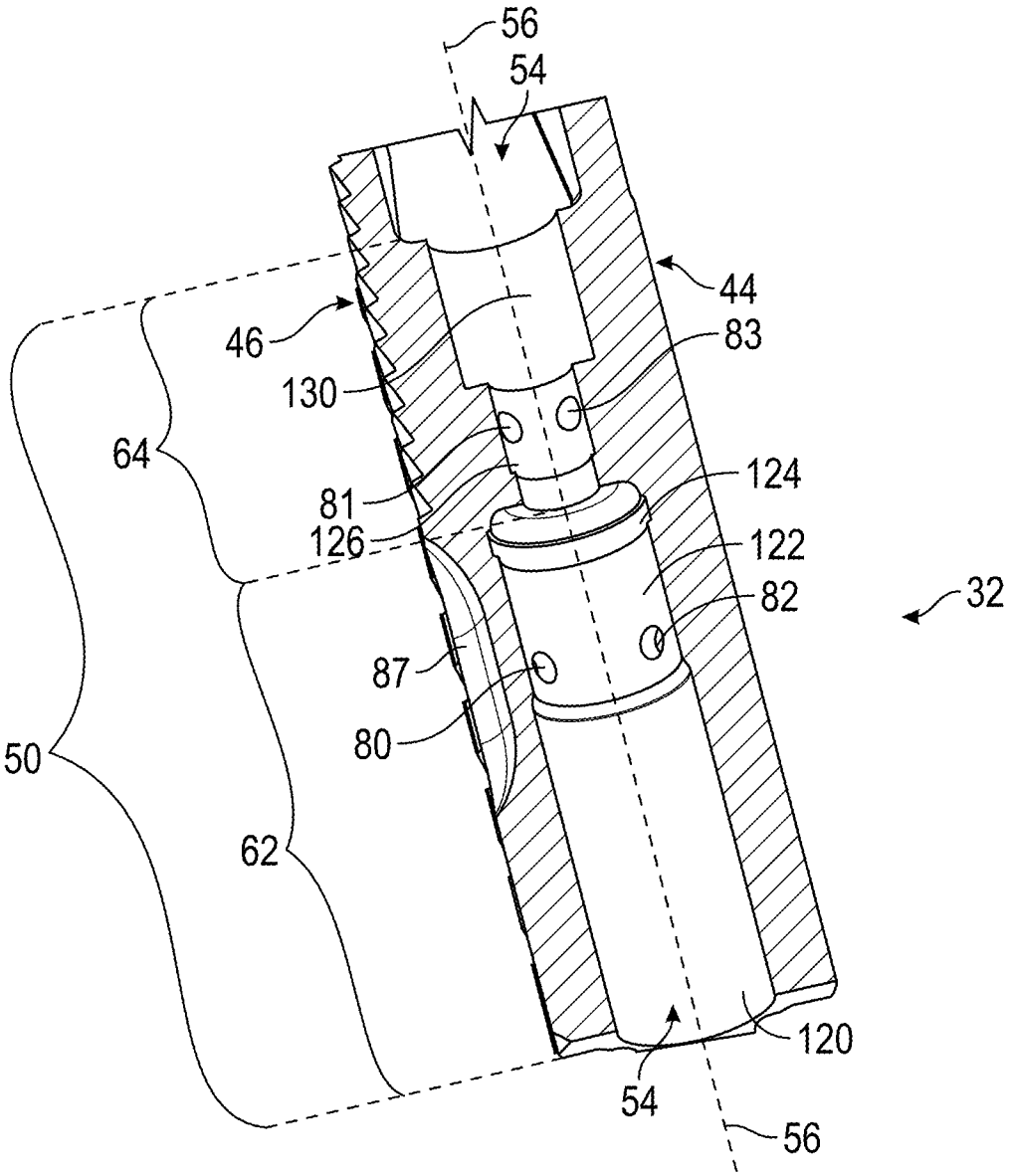
FIG. 5 shows a top section view of the bolt carrier without the bolt.

FIG. 5 shows an angled section view of the bolt carrier 32 from top down without the bolt or firing pin. With the bolt removed, additional downward gas holes 81 and 83 are visible in the bolt tail channel 126. These act as emergency relief ports to mitigate structural damage in the event of a case head separation. Bottom gas holes 80, 81, 82, and 83 are shown to be angled such that the internal ends within the carrier are closer to their corresponding lateral parts and the outer portions that exit the carrier are farther apart. Specifically, bottom gas holes 80 and 82 are oriented towards each from outside to the inside of the carrier gas rings channel, and bottom holes 81 and 83 are similarly oriented from the outside to the inside of the bolt tail channel.

Figure 6:
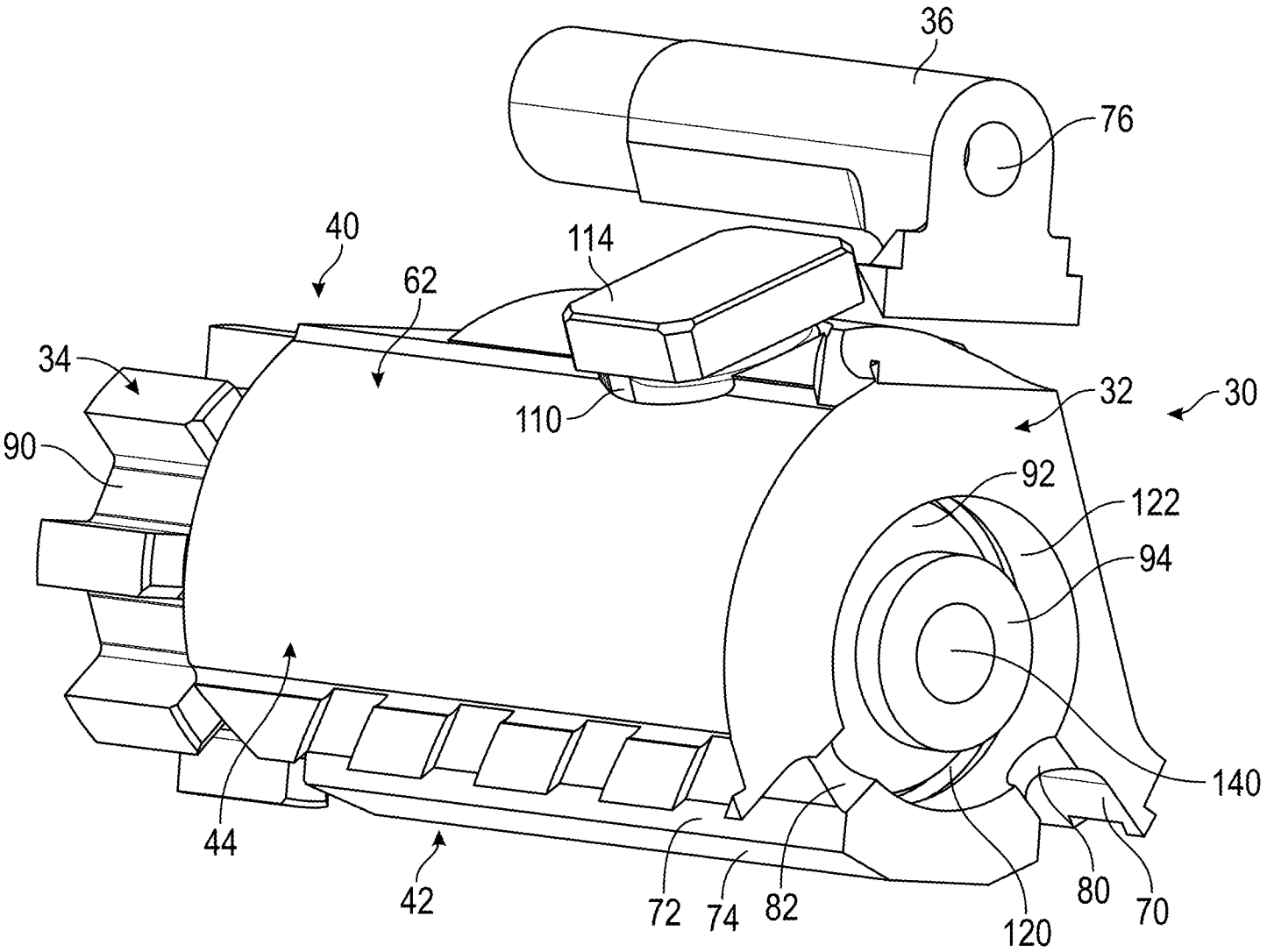
FIG. 6 shows a rearward section view of the bolt carrier assembly with the bolt carrier, bolt, carrier key, and bottom gas holes partially displayed.

FIG. 6 shows an angled rearward partial section view of the bolt carrier assembly 30 left side 44, specifically the bolt body section 62 of the bolt carrier 32 with the bolt. The bolt 34 is inserted into the bolt carrier with the body 92 within the bolt body channel 120 and the bolt gas rings section 94 within the carrier gas rings channel 122. The firing pin 140 is in the bolt within the firing pin channel 102. The cam pin 114 can be seen inserted into the bolt carrier through cam hole 110. A part of carrier key 36 is shown, with gas channel 76 visible. Bottom gas hole 82 is visible transversing completely through the bolt carrier from the left groove 72 on the bottom side 42 of the bolt carrier. Similarly, gas hole 80 is seen transversing completely through the bolt carrier from the right groove 70. Both grooves are separated by a boss 74.

Figure 7:
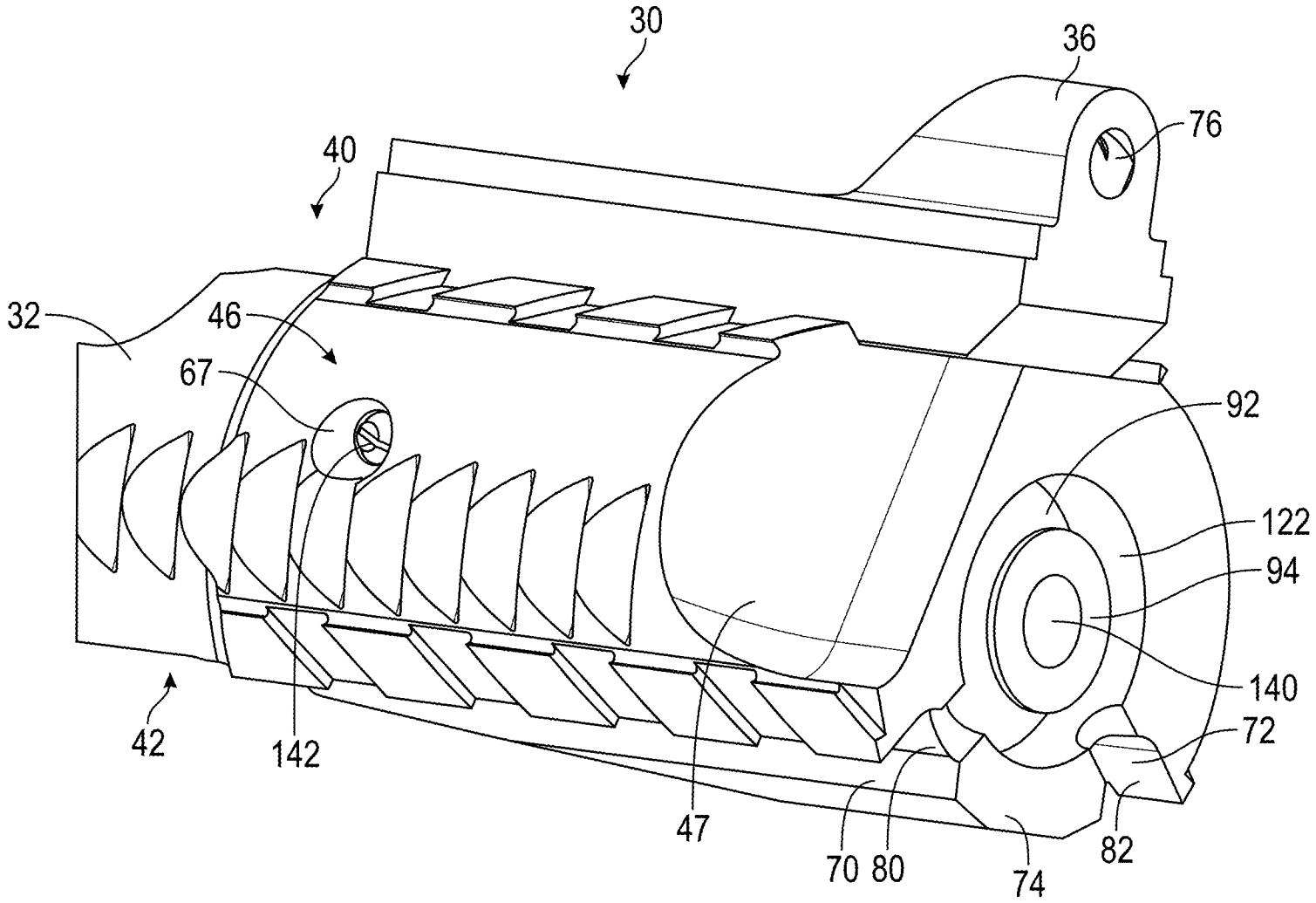
FIG. 7 shows a forward section view of the bolt carrier assembly with the bolt carrier, bolt, carrier key, and bottom gas holes partially displayed.

FIG. 7 shows an opposing angle view to FIG. 6, an angled front facing partial section view of the bolt carrier assembly 30 showing a portion of bolt carrier 32 bolt section 50 from the right side 46. The bottom gas hole 80 is seen traversing completely through the bolt carrier in the right groove 70 and the bottom hole 82 is seen transversing completely through the left groove 72, with the boss 74 between the grooves. The carrier key 36 is seen attached to the bolt carrier and has gas channel 76 visible. The firing pin retaining pin 142 is shown inserted through retaining pin hole 7.

Figure 8:
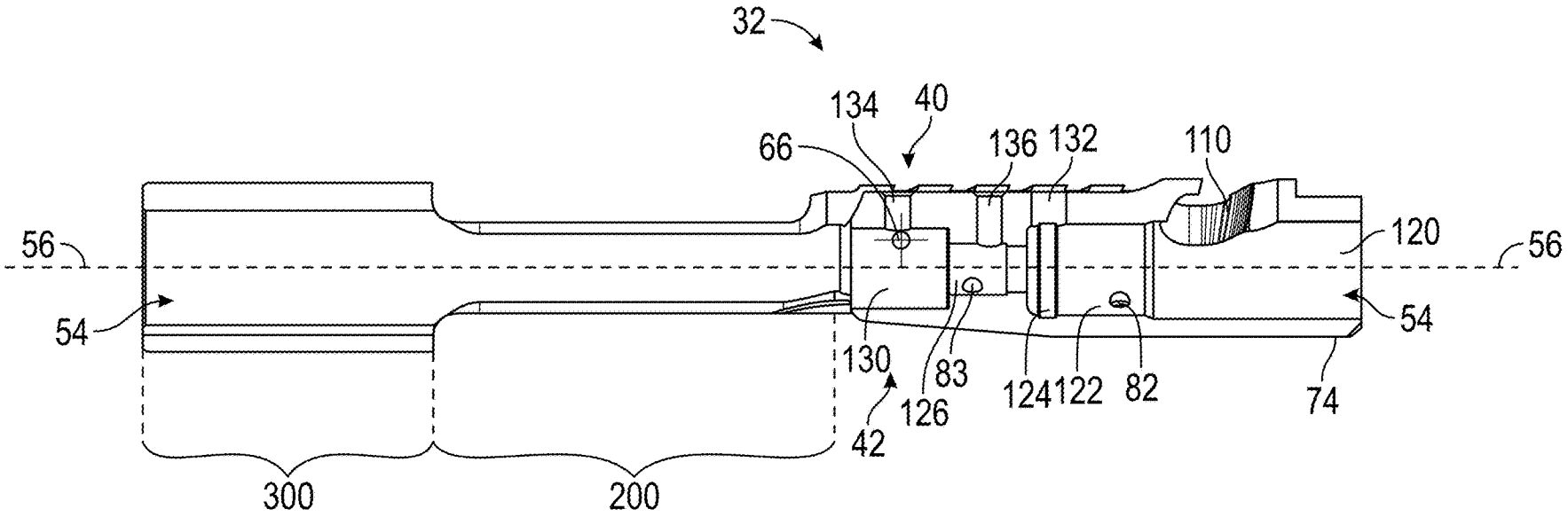
FIG. 8 shows a side section view of the bolt carrier without the bolt.

FIG. 8 shows a right-side section view of the bolt carrier 32. The lower gas hole 82 is shown within the carrier gas rings channel 122, along with gas hole 83 within the bolt tail channel 126. The carrier key gas hole 132, also referred to as a first gas passage, is in communication with the carrier key gas channel 76 (not shown here) and has gas passing from the carrier key into the bolt carrier gas channel 122. The carrier gas key hole 132 is shown forward of holes 134 and 136, which are used to retain the carrier key 36 (not shown here but previously shown in FIG. 7). The path of travel for cam pin 114 is shown via cam hole 110.

Figure 9A:
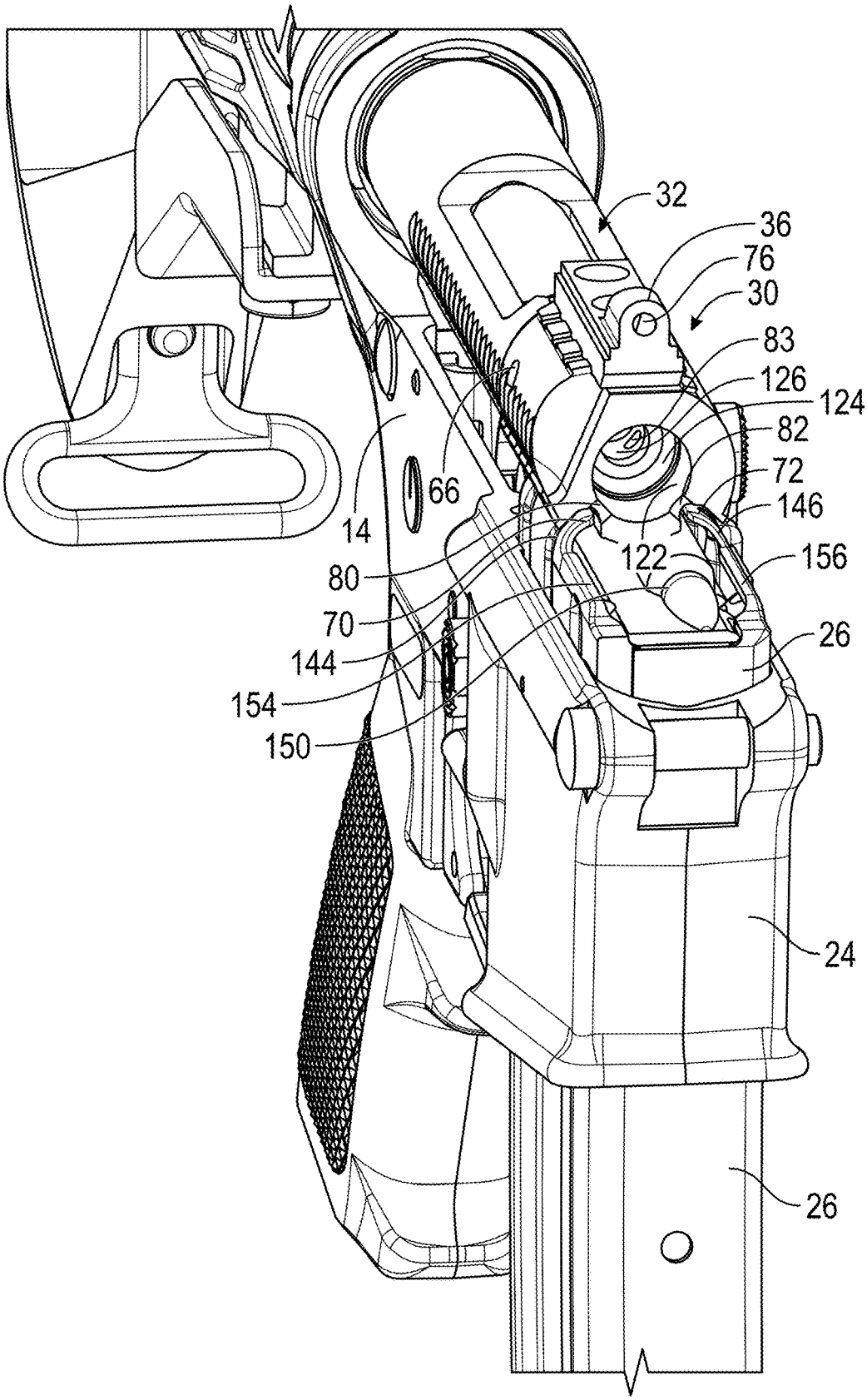
FIG. 9A shows an angled forward section view of the bolt carrier, without the bolt, inserted into a firearm that has a magazine inserted.
Figure 9B:
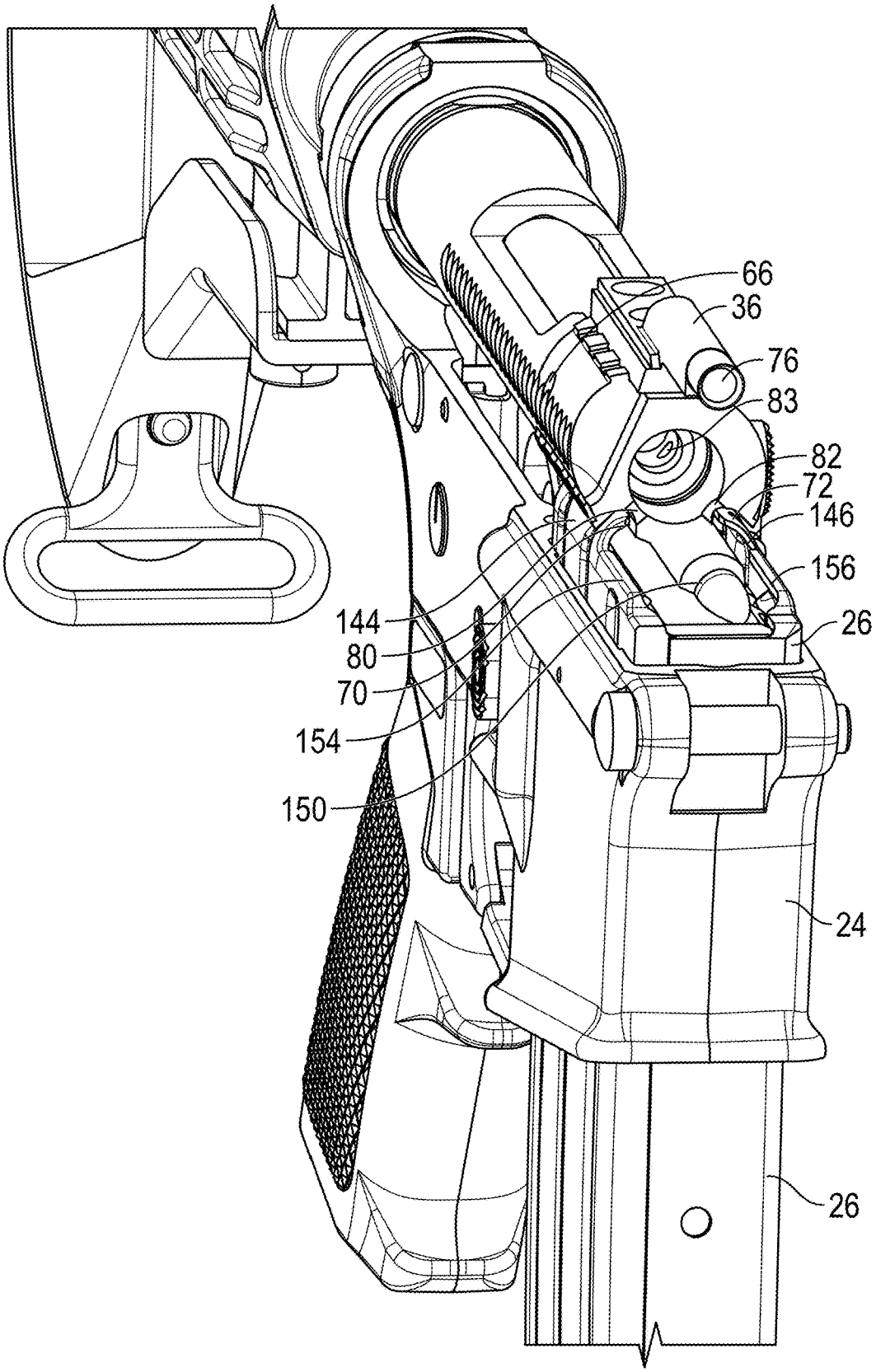
FIG. 9B shows an angled forward section view of the bolt carrier, without the bolt, inserted into a firearm that has a magazine inserted.

FIG. 9*a* and FIG. 9*b* show top angled section views of the bolt carrier group 30 installed in a rifle 10 with a magazine 26 inserted into the magazine well 24. The carrier key 36 is partially sectioned to show the gas channel 76 that would extend over the cam hole 110. All four bottom gas holes are present in this embodiment. Bottom gas hole 80 is shown at the carrier gas ring channel 122 in line with the right groove 70, which is communicating with the right feed lip 144. Bottom hole 82 is shown at the carrier gas ring channel 122 in line with left groove 72, which is communicating with the left feed lip 146. Bottom hole 83 is shown at the carrier gas ring channel 126 posterior to bottom hole 82. The boss 74 between the grooves 70 and 72 contacts a magazine follower 150 as shown here, or an ammunition cartridge if the magazine contains ammunition, that is between the feed lips 144 and 146. In front of the feed lips are corresponding lower sections 154 and 156 that do not contact the grooves 70 and 72. The gas from a discharged cartridge traveling to and through the carrier would exit through bottom holes 80 and 82, towards the magazines feed lips 144 and 146, in this embodiment exiting the carrier at the spaces 154 and 156 just in front of the speed lips, the space between the magazine and holes allowing for the gas to be further diverted from the user in a downward manner.

Figure 10:
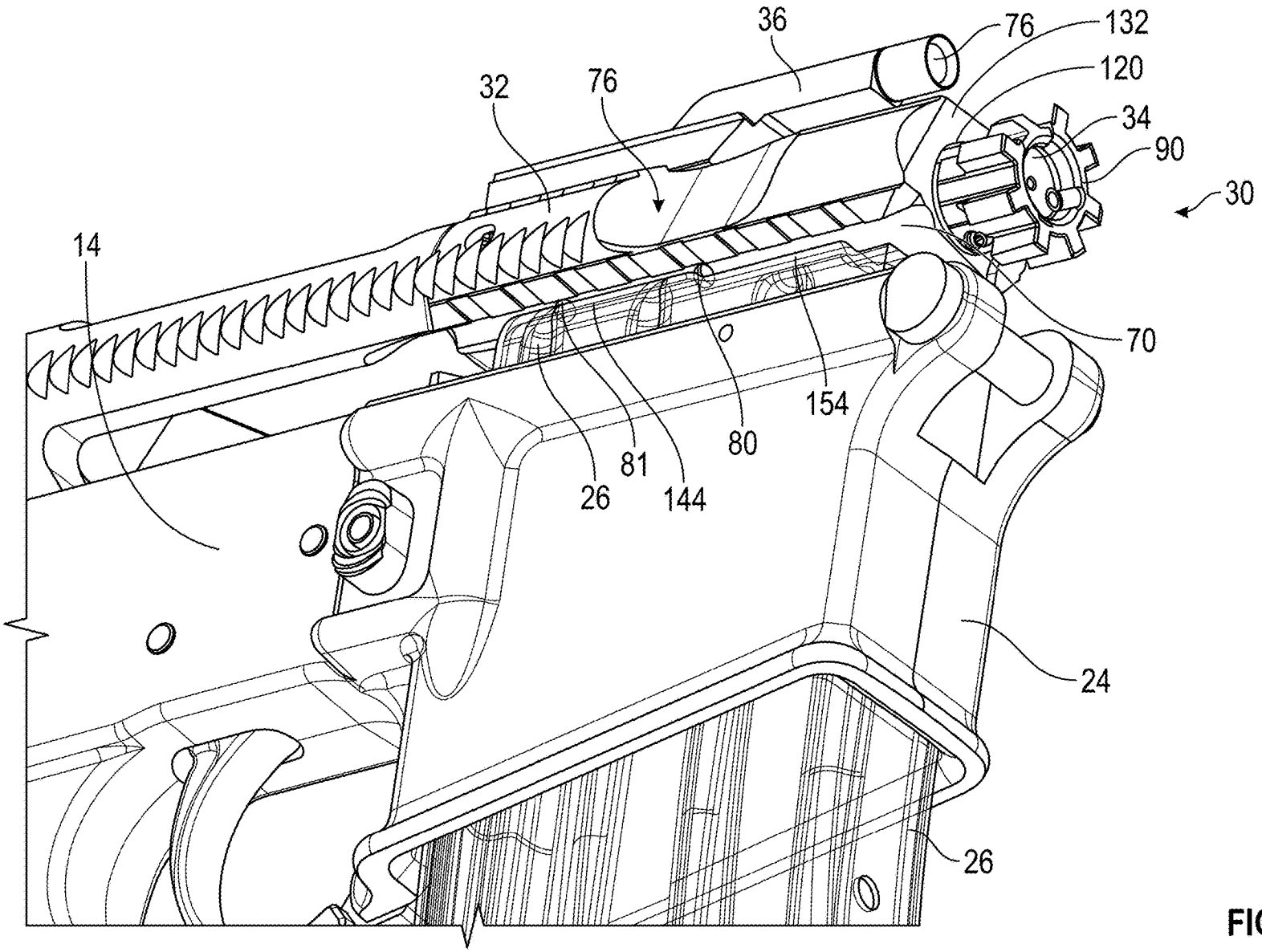
FIG. 10 shows a bottom angled view of the bolt carrier assembly in a fully seated configuration in relation to a firearm lower receiver having a magazine inserted.

FIG. 10 shows a bottom angled view of the bolt carrier group 30 as it would be positioned installed in the upper receiver of a rifle (not shown here) on top of a lower receiver 14 having a magazine well 24 with a magazine 26 inserted. The carrier 32 is on top of the magazine, with the right groove 70 in communication with the right magazine feed lip 144. Forward of the feed lip 144 is a lowered section 154. The lowered section 154 creates a space between that allows gas to travel downwards into and around the outside of the magazine as it passes from bottom hole 80. Bottom hole 81 can be seen partially behind feed lip 144.

In other embodiments there may be only a single bottom gas hole or exit aperture 80, the single or additional plurality of holes 81, 82, 83 may be shifted in placement along the grooves 70 and 72 of the bottom of the bolt carrier 32 and may have a varying bore angle to change the direction of expelled gases. Still in further embodiments the bolt carrier includes both lateral gas holes 86 and one or more bottom gas holes in order to allow further improved discharge of gases.

I claim:

1. A breech bolt assembly comprising of:

a bolt carrier being an elongated body having a top side and a bottom side, a left side and right side, and defining a bolt section, hammer section, and end section;

said body having an exterior and a central bore along a central bore axis;

said bolt section having a bolt head end, a bolt body section, and a bolt tail end section;

the bolt body section defining a bolt body channel and a gas ring channel;

the bolt tail end defining a boat tail channel and a carrier firing pin channel;

the bolt body channel, gas ring channel, bolt tail channel, and carrier firing pin channel aligned along the central bore axis;

a bottom side of the bolt section defining a left groove and a right groove with a boss in between, and at least one bottom gas channel traversing from an exterior to the central bore; where the bottom side of the bolt section has a bottom channel traversing from an exterior of the left groove to the bolt body channel, a bottom channel traversing from the an exterior of the left groove to the bolt tail channel, a bottom channel traversing from an exterior of the right groove to the bolt body channel, and a bottom channel traversing from an exterior of the right groove to the bolt tail channel;

a bolt; and a carrier gas key.

2. The breech bolt assembly of claim 1 where the bottom side of the bolt section has a first bottom channel traversing from the exterior to the bolt body channel, and a second bottom channel traversing from the exterior to the boat tail channel.

* * * * *